US005376048A

United States Patent [19]

Whiteside

[11] Patent Number: 5,376,048

[45] Date of Patent: Dec. 27, 1994

[54] CONTINUOUS BUSINESS FORMS/INTERMEDIATES

[75] Inventor: Robert Whiteside, Leicestershire, Great Britain

[73] Assignee: Moore Business Forms, Inc., Grand Island, N.Y.

[21] Appl. No.: 96,169

[22] Filed: Jul. 23, 1993

Related U.S. Application Data

[63] Continuation-in-part of Ser. No. 19,836, Feb. 19, 1993, Pat. No. 5,294,041.

[30] Foreign Application Priority Data

Jul. 29, 1992 [GB] United Kingdom ..... 9216251
Aug. 1, 1992 [GB] United Kingdom ..... 9216427

[51] Int. Cl.[5] ..... B65D 27/10; B41L 1/26

[52] U.S. Cl. ..... 462/6; 462/900; 462/902; 283/116; 229/69; 229/92.1

[58] Field of Search ..... 462/6, 900, 902; 283/116; 229/69, 29.1

[56] References Cited

U.S. PATENT DOCUMENTS 4,928,875 5/1990 Hutchinson ..... 229/92.1
5,174,493 12/1992 File ..... 229/92.1 X
5,289,972 3/1994 Sauerwine et al. ..... 229/92.1 X

*Primary Examiner*—Mark Rosenbaum
*Assistant Examiner*—Frances Han
*Attorney, Agent, or Firm*—Nixon & Vanderhye

[57] ABSTRACT

A business form intermediate comprises a sheet that is Z-folded first about first and second fold lines to define an outgoing mailer. The business form has first, second and third panels with an outgoing address area on the first face of the third panel, and an O.P.A.S. patch on the first face of the first panel. The patch obscures a PIN number or other confidential information underneath it. Pressure seal adhesive formed along the margins of the paper sheet of the intermediate holds the panels together once Z-folded. Masking is applied on panel faces as necessary in order to obscure all interior information of the mailer. A reply mailer may be constructed from the second and third panels using a window in the third panel overlying reply address indicia on the second panel first face and rewettable adhesive strips on the second panel first face.

24 Claims, 11 Drawing Sheets

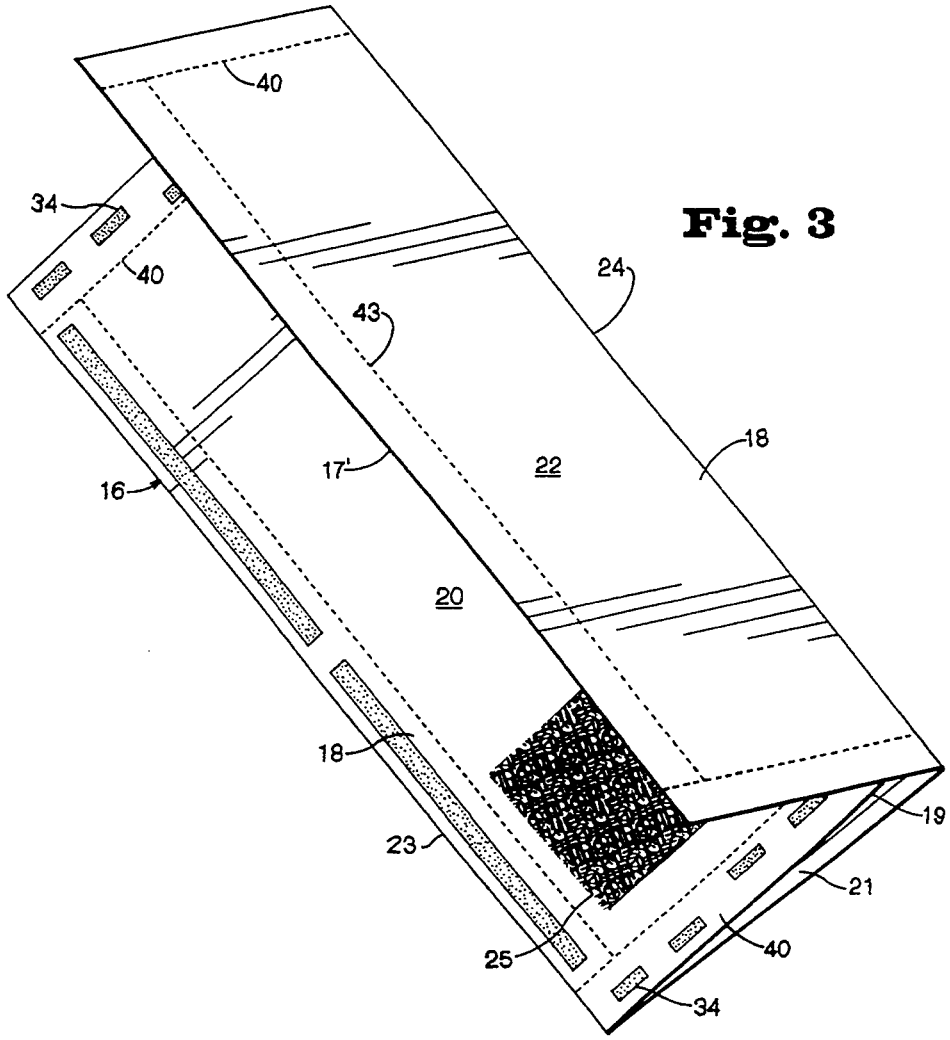
Fig. 3
Fig. 4
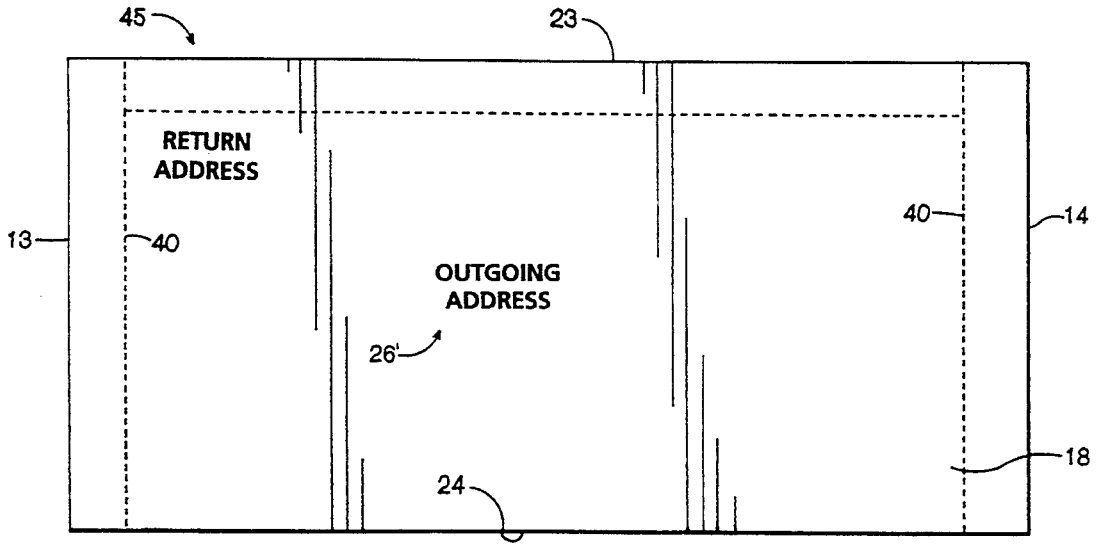

Fig. 10
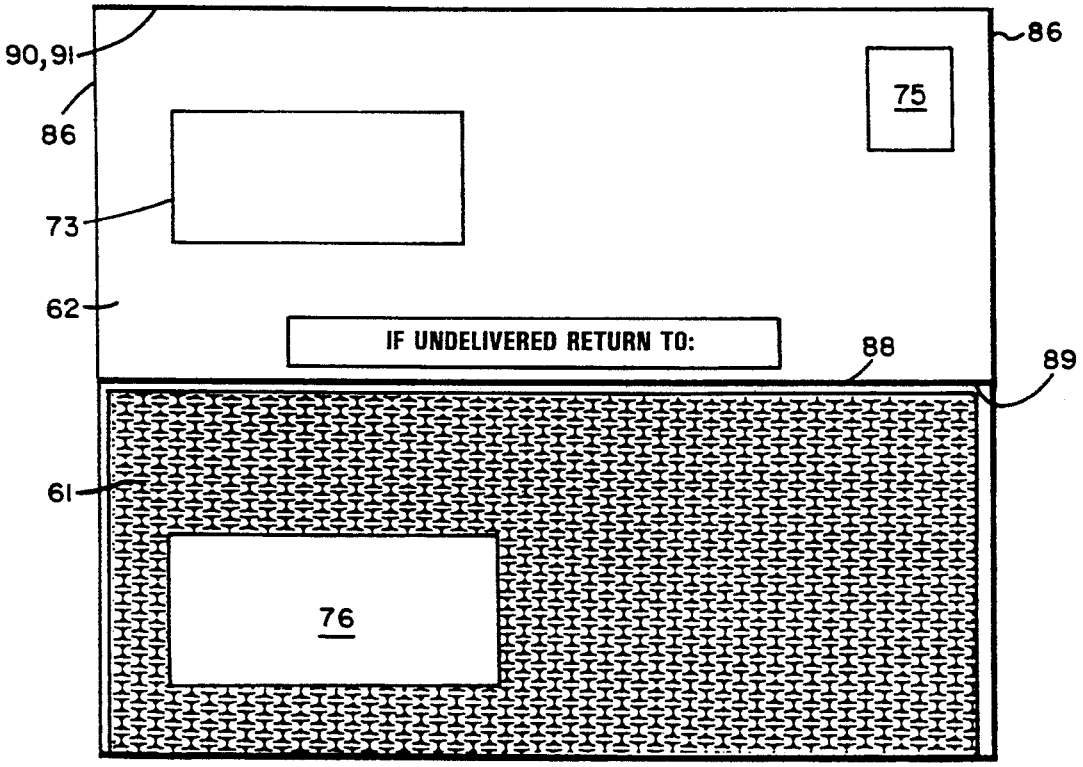
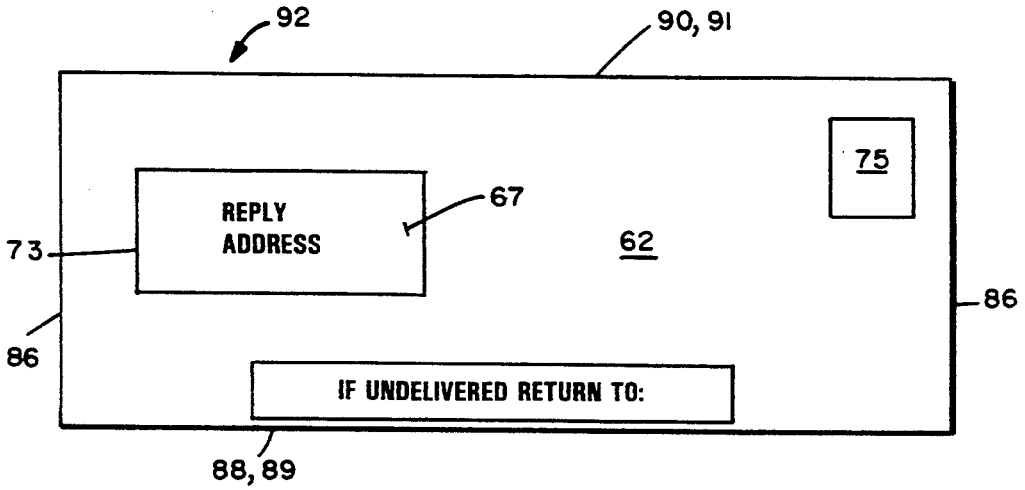
Fig. 11

CONTINUOUS BUSINESS FORMS/INTERMEDIATES

CROSS-REFERENCE TO RELATED APPLICATION

This application is a continuation-in-part of application Ser. No. 08/019,836 filed Feb. 19, 1993 now U.S. Pat. No. 5,294,041.

BACKGROUND AND SUMMARY OF THE INVENTION

This invention relates to continuous business forms assemblies (business form intermediates) which are subsequently processed to become individual sealed mailers and is particularly concerned with continuous business forms assemblies comprising a plurality of individual business forms in continuous format and each intended to carry confidential information such as a personal identification number (PIN number) at a predetermined position on the form so that it will be hidden when printed on the form and will be inside the sealed mailer.

Conventionally continuous business forms have longitudinal marginal edge portions provided with feed holes for accurate correlation with a printer or other processing machines and are divided into a number of form or mailer lengths by transverse lines of perforation. Such continuous business forms are printed with all the information common to all forms, are provided with all adhesive necessary for forming sealed mailers, are provided with any patches or windows required and are then fan folded and boxed in appropriate lengths for dispatch to a user who wishes to personalize individual form lengths, form them into mailers and dispatch them to customers. In the particular case of forwarding their PIN numbers to customers this user would be a bank or credit card issuing organization.

In U.S. Pat. No. 4,824,142 (the disclosure of which is hereby incorporated by reference herein) there is described a continuous business form assembly for recording and dispatching PIN numbers. A continuous web is divided into form lengths and an area of each form Length intended to receive a customer's PIN number has adhered thereto a masking patch of the type known as an O.P.A.S. patch. Such a patch has a top surface printed with a masking pattern, and a lower surface coated with a CB (coated back) coating and the area receiving the patch is coated with a CF (coated front) coating to act with the CB coating on the patch to produce on the area a reproduction of a PIN number which has been impacted on the top surface of the patch. Only when the patch is peeled away can the number be seen.

The web of that assembly is formed into mailers by one of two methods; either the web is plow folded about a longitudinal central line into two overlying panels which are adhered together to form each mailer or two separate webs are collated together and secured around the edges of each form length.

As the patch requires impact printing to transfer the impression of the PIN number onto the web area beneath the patch and an impact printer can only print on one side of the web, the addressee details must be printed on the same side of the web and in the prior art such a system requires the address to be viewed through a window.

According to the present invention, an improved continuous business form assembly (intermediate) suitable for impact printing to receive PIN numbers (or other confidential information) and personalized details of addressees and which can then be folded and sealed to provide sealed final business forms (mailers) in which the PIN numbers will be enclosed, is provided.

According to one aspect of the present invention a business form intermediate is provided. The intermediate has the following elements: A sheet having first and second opposite faces, parallel first and second edges, and parallel third and fourth edges perpendicular to the first and second edges. First and second fold lines parallel to the first and second edges, and dividing the sheet into first, second, and third panels, the first panel bordered by the first edge and first fold line, and the second panel between the first and third panels. One of the second and third panels has an outgoing address area formed on the first face thereof. The first panel has a patch, with inner and outer surfaces, adhesively secured to the first face thereof, the patch having an outer surface with masking means associated therewith, and transfer means provided between the patch inner surface and the first panel first face. And, adhesive patterns associated with the panels for holding the business form when folded into a C-fold configuration, folded about the first fold line first, and then the second fold line, to provide the first panel first surface covered by the third panel so that the patch is not visible from the exterior of the formed mailer.

Preferably the panel having the outgoing address area formed on its first face is the second panel, and the adhesive patterns comprise cooperating adhesive patterns formed on the first panel first face and third panel second face, and cooperating adhesive patterns on the second and first panels second faces. The adhesive patterns preferably comprise pressure seal adhesive. Masking indicia is provided on the third panel for minimizing the transparency and translucency thereof, such is on both faces or merely the second face. Also masking indicia is printed on the second face of the first panel.

The business form intermediate is preferably in continuous format, with like sheets connected along the first and second edges thereof by lines of weakness (e.g. perforations). Also indicia describing the utilization of a PIN number imaged on the first panel first face adjacent the patch is preferably provided. The transfer means typically comprises CB and CF coatings on the patch and a portion of the first panel first face. Lines of weakness (perforations) are disposed parallel to the third and fourth edges interior of the patterns of adhesive for allowing ready opening of the mailer once C-folded with the panels thereof adhesively secured together.

The invention also comprises a business form per se, namely a mailer type business form. The components of the business form are: A sheet having first, second and third panels, each with a first face and a second face, C-folded about fold lines so that said third panel second face engages the first panel first face and the first panel second face engages the second panel second face. One of the second and third panels having an outgoing address area formed on the first face thereof. The first panel having a patch, with inner and outer surfaces, adhesively secured to the first face thereof, the patch having an outer surface with masking means associated therewith, and transfer means provided between the patch inner surface and the first panel first face. And, adhesive patterns holding the second panel second face and first panel second face, and third panel second face and first panel first face, together in the C-folded configuration.

The business form according to the invention typically comprises outgoing address indicia printed in the outgoing address area (e.g. on the second panel first face) and a PIN number on the first panel first face covered by the patch.

According to another aspect of the present invention, a business form intermediate is provided comprising the following elements: A sheet having first and second opposite faces, parallel first and second edges, and parallel third and fourth edges perpendicular to the first and second edges. First and second fold lines parallel to the first and second edges, and dividing the sheet into first, second, and third panels, the first panel bordered by the first edge and first fold line, and the second panel between the first and third panels. One of the second and third panels having an outgoing address area formed thereon. One of the first and second panels having a patch, with inner and outer surfaces, adhesively secured to the first face thereof, the patch having an outer surface with masking means associated therewith, and transfer means provided between the patch inner surface and the first or second panel first face. And, adhesive patterns associated with the panels for holding the business form in a Z-fold configuration when folded about the first and second fold lines to provide the first panel first surface covered by the second panel first face so that the patch is not visible from the exterior of a formed mailer, but so that the outgoing address area is visible from the exterior of a formed mailer.

The outgoing address area is preferably formed on the first face of the third panel, and there is also provided a window in the third panel adjacent the address area. Return and reply indicia are printed on the second and first face, respectively, of the second panel to align with the window in forming an outgoing mailer, or return mailer. Provision of the return mailer is facilitated also by providing strips of activatable (e.g. rewettable) adhesive on the first face of the second panel to cooperate with the first face of the third panel to form a reply mailer after a mailer constructed from the intermediate is opened up.

According to another aspect of the present invention, a mailer type business form is provided which comprises the following elements: A quadrate sheet having first, second and third panels, each with a first face and a second face, Z-folded about fold lines so that the third panel second face engages the second panel second face and the first panel first face engages the second panel first face, to define first through fourth edges of each panel. One of the second and third panels having an outgoing address area formed thereon. One of the first and second panels having a patch, with inner and outer surfaces, adhesively secured to the first face thereof, the patch having an outer surface with masking means associated therewith, and transfer means provided between the patch inner surface and the first panel first face. And, adhesive patterns holding the panels together in the Z-folded configuration, with the first faces of the first and second panels in face-to-face engagement with each other.

It is the primary object of the present invention to provide advantageous continuous business form intermediates, and C-folded and Z-folded mailer type business forms produced therefrom, that are easy to print (including a PIN number which is maintained confidential), and then make into a mailer. This and other objects of the invention will become clear from an inspection of the detailed description of the invention and from the appended claims.

BRIEF DESCRIPTION OF THE DRAWINGS

FIG. 3 shows diagrammatically one mailer length being folded to form a sealed mailer;

FIG. 4 is a top plan view of an exemplary mailer according to the invention after the panels are C-folded and adhesively secured together;

FIGS. 9 and 10 are plan views of the opposite sides of the opened mailer of FIGS. 7 and 8 after one panel has been removed and the remaining two panels have been opened up;

FIG. 11 is a top plan view of a return mailer constructed according to the invention from the outgoing mailer of FIGS. 7–10.

DETAILED DESCRIPTION OF THE DRAWINGS

Figure 1:
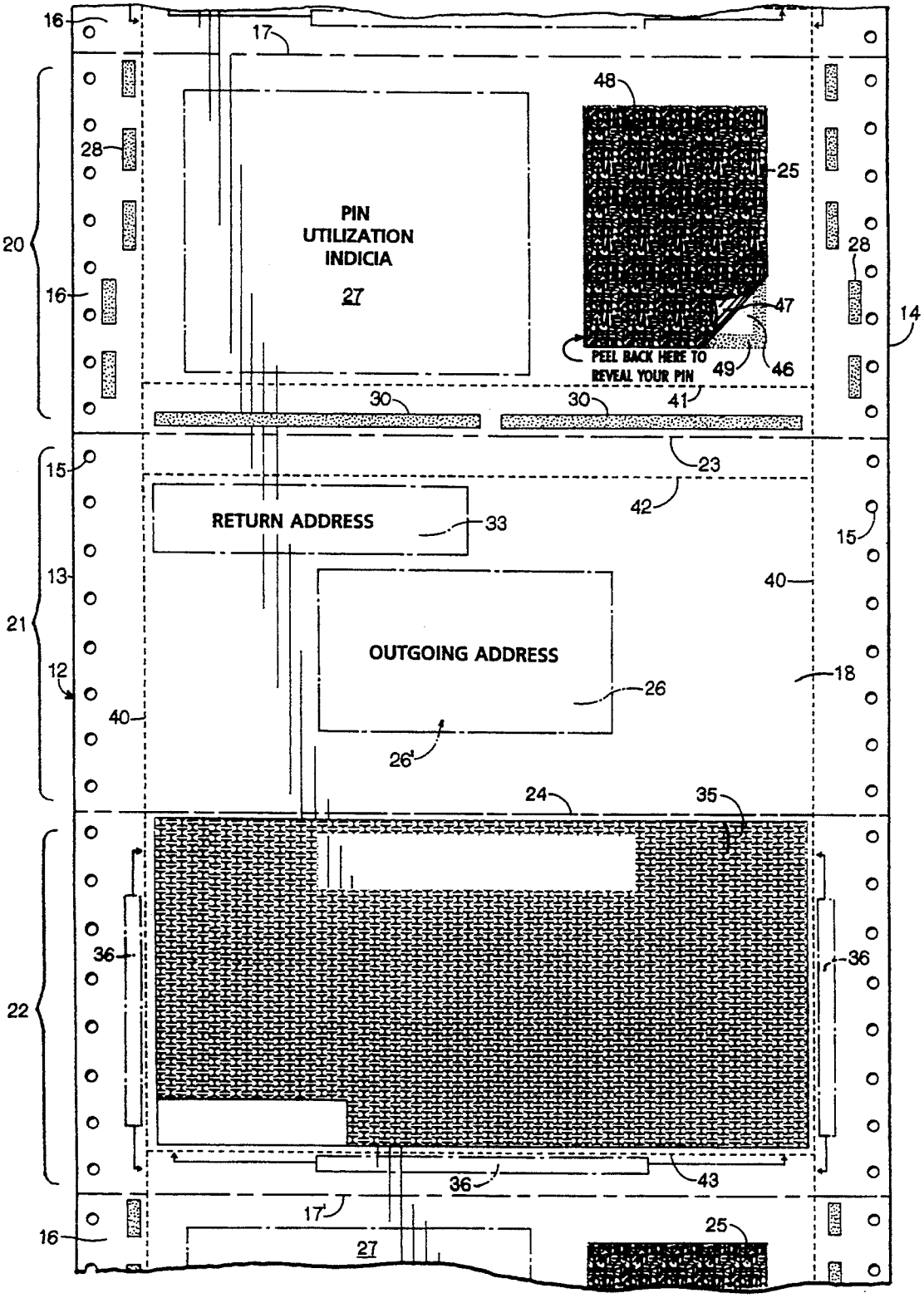
FIG. 1 shows one side of one mailer length forming part of a continuous business form intermediate according to the invention.

A continuous business form intermediate according to the invention comprises a continuous web 12 having longitudinal edges 13, 14 formed with marginal feed apertures 15 for guiding and accurately correlating the web with a printer or other processing machines. The web is divided, in known manner, into a plurality of form lengths 16 by transverse lines of weakness (e.g. perforations 17, 17') defining first and second edges, each form length comprising a sheet of paper designed to form an individual sealed mailer. The web has a front (first) face 18 shown in FIG. 1 and a rear (second) face 19 shown in FIG. 2 and is printed on both sides with information common to all forms/mailer lengths.

Figure 2:
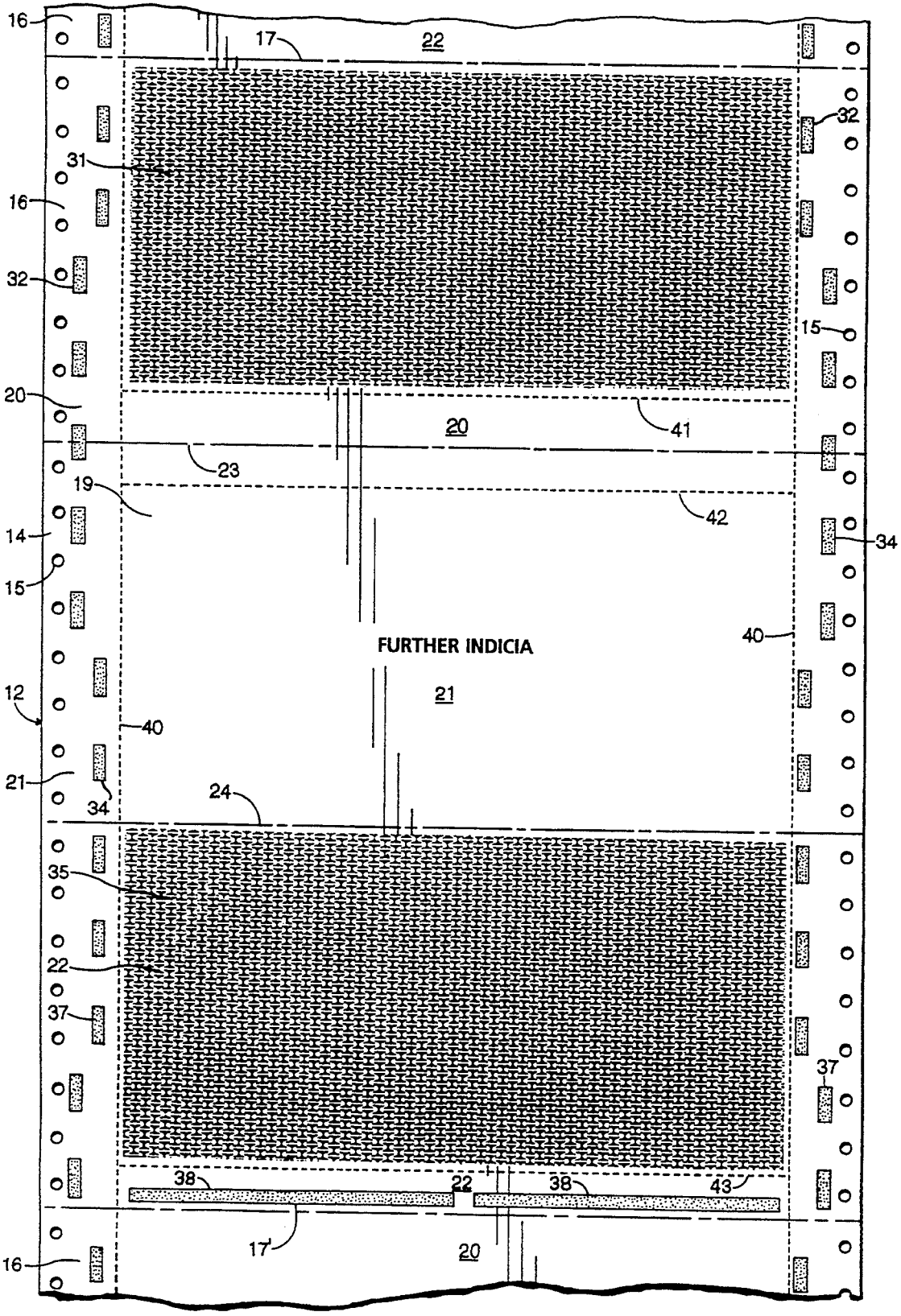
FIG. 2 shows the other side of the mailer length of FIG. 1 forming parts of a continuous business form intermediate.

Each form intermediate (sheet) is intended to be C-folded to form a mailer type business form 45 (see FIG. 4) and for this purpose is divided into three substantially equal panels 20, 21, 22 by first and second fold lines indicated diagrammatically at 23 and 24 in FIGS. 1 and 2. The first panel 20 has on its face 18 an area 46 (see FIG. 1) covered by a masking O.P.A.S. patch 25 bearing transfer material. For example CB transfer material 47 is on the rear face of patch 25, cooperating with CF material (not seen) on area 46 of face 18 of panel 20. Masking indicia 48 is printed on the top face of patch 25. That is, the patch 25 per se is as in U.S. Pat. No. 4,824,142.

The masking patch 25 is adhered to the edges of the area 46 so that it can be peeled off to reveal visible information transferred to the area by impact printing on the masked surface of the patch, as by adhesive 49 (FIG. 1). The masking 48 on the patch 25 normally obscures any printing thereon but, if necessary, the impact printing on the patch can be made without using a printing ribbon or ink.

The second panel 21 has an area 26 adapted to receive personalized details of an addressee (an outgoing address area) also to be impact printed on the first face 18 of the sheet. Outgoing addressee indicia 26' ultimately is printed on area 26. Alternatively, the area 26 could be on the first face 18 of third panel 22.

Initially the manufacturer of the continuous business form will print on both sides of the form all information common to all form lengths, will apply the patches 25 and will apply adhesive patterns 28, 36, etc. necessary for forming the eventual sealed mailers 45. The manufacturer will then fan fold the web along perforation lines 17, 17' (to become first and second edges of each mailer 45), and separate and box the form intermediate in lengths suitable for conveyance to a user. Such continuous form intermediates are supplied to a user such as a bank who passes the forms continuously through an impact printer so as to supply the details of the PIN number and addressee details to each individual form length. The forms are then continuously burst, folded and sealed and dispatched to individual customers.

In the arrangement shown each mailer length (sheet) is preprinted with information and supplied with adhesive as follows:

First Panel 20

Face 18—in area 27 instructions (indicia) for viewing, utilizing, and retaining confidential the PIN number; along both marginal edges staggered discreet patches of pressure seal adhesive 28 and along the transverse first edge 17 a line of pressure seal adhesive 30. Face 19—masking printing 31 at least in an area corresponding with the position of the patch 25; and discrete staggered areas of pressure seal adhesive 32 along the longitudinal edges.

Second Panel 21

Face 18—in an area 33 details of the sender, and wording such as "Private and Confidential" and "See reverse side for opening instructions"; no adhesive is on this side of the form as it forms one outside surface of the eventual sealed mailer. The other face 19 of the panel 21 is available for any message ("further indicia") to the outgoing addressee and is formed with staggered discrete areas of pressure seal adhesive 34 along its longitudinal marginal areas.

Third Panel 22

Face 18—forms the other outside side of the sealed mailer 45 and is covered with masking printing 35 and instructions at 36 for opening the mailer 45. On its other face 19, the panel 22 is also printed with masking printing 35 and has discrete staggered areas 37 of pressure seal adhesive along its longitudinal marginal edges and a line of pressure seal adhesive 38 along its second edge 17'.

Once the form intermediate has been printed by the user with the personalized details the form is passed through a burster to separate each form intermediate length from the continuous web, and is C-folded (see FIG. 3) first along line 23 to bring first face 19 of first panel 20 into contact with second face 19 of second panel 21, and then along line 24 to bring second face 19 of third panel 22 into contact with first face 18 of first panel 20. The areas of pressure seal adhesive will then all come into contact with an area of pressure seal adhesive on an adjacent panel and the form is passed through a commercial pressure edge sealing device which applies pressure to activate the adhesive and provide sealed mailers 45 (FIG. 4), which have the patches 25 inside and the addressee information in area 26 on the outside.

The forms 45 preferably are provided with longitudinal perforation lines 40 along each marginal edge inside the lines of adhesive and with transverse perforation lines 41, 42 and 43 on the panels 20, 21 and 22 respectively inside the transverse lines of adhesive 30 and 38 and the transverse marginal portion on panel 21 which will correspond with these lines of adhesive when the mailer is folded and sealed.

The sealed mailer is opened by the eventual customer by tearing along the longitudinal perforation lines 40 to remove the marginal longitudinal edge portions and then tearing along the coinciding lines 41, 42 and 43 to remove these transverse marginal edge portions. The result is that the panel 20 bearing the PIN number under patch 25 is completely separated from the panel 21 bearing the addressee details, and the patch 25 removed to reveal the PIN number.

The patterns of adhesive 32, 34, 37, etc. are staggered and spaced so that adhesive on any form length does not contact adhesive on any adjacent form length when the continuous form is fan folded about the perforation lines/edges 17, 17'.

Figure 5:
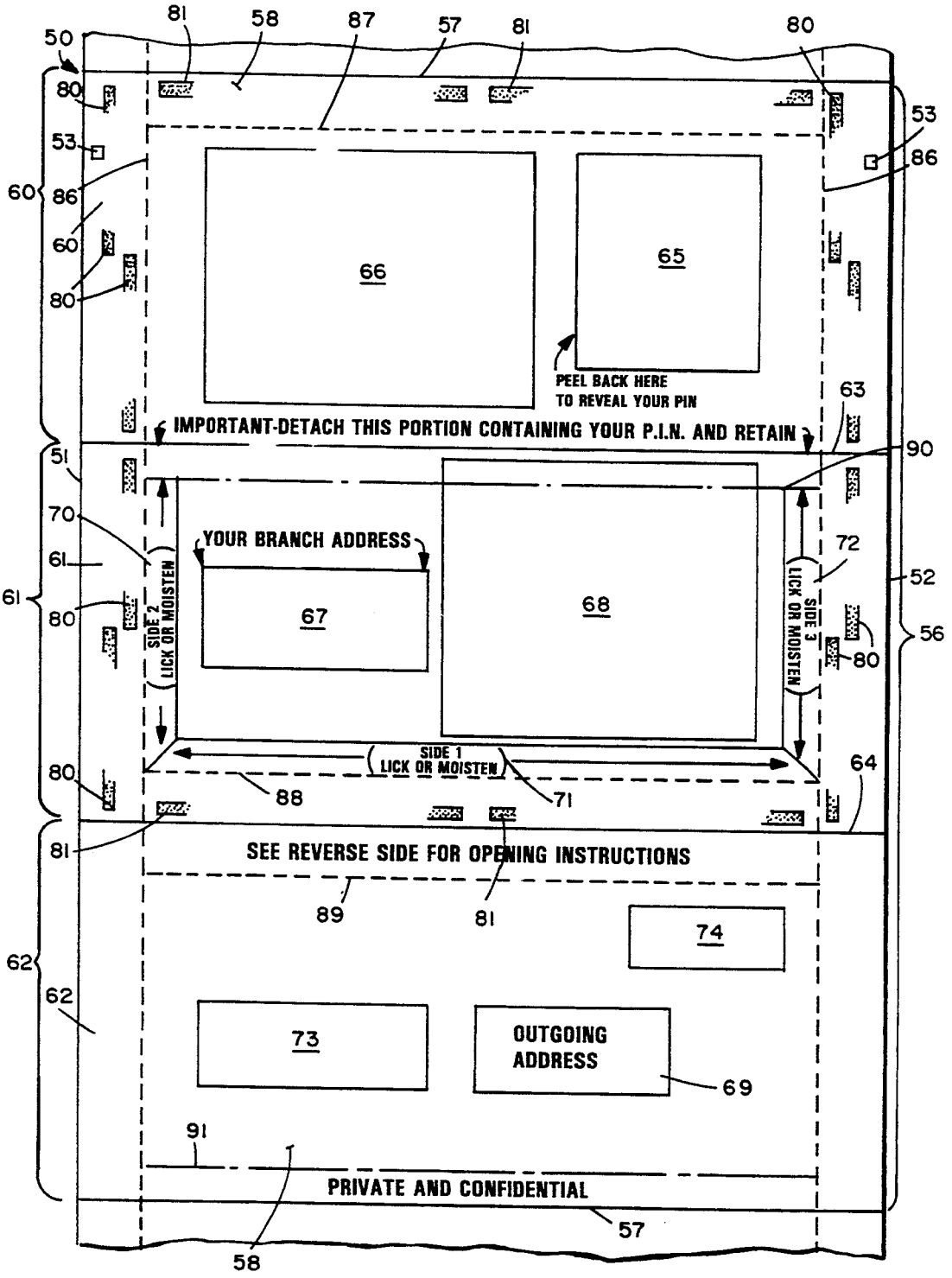
FIG. 5 is a top plan view of a first face of a second embodiment of business form intermediate according to the present invention utilizable for Z-folding to form a mailer type business.
Figure 6:
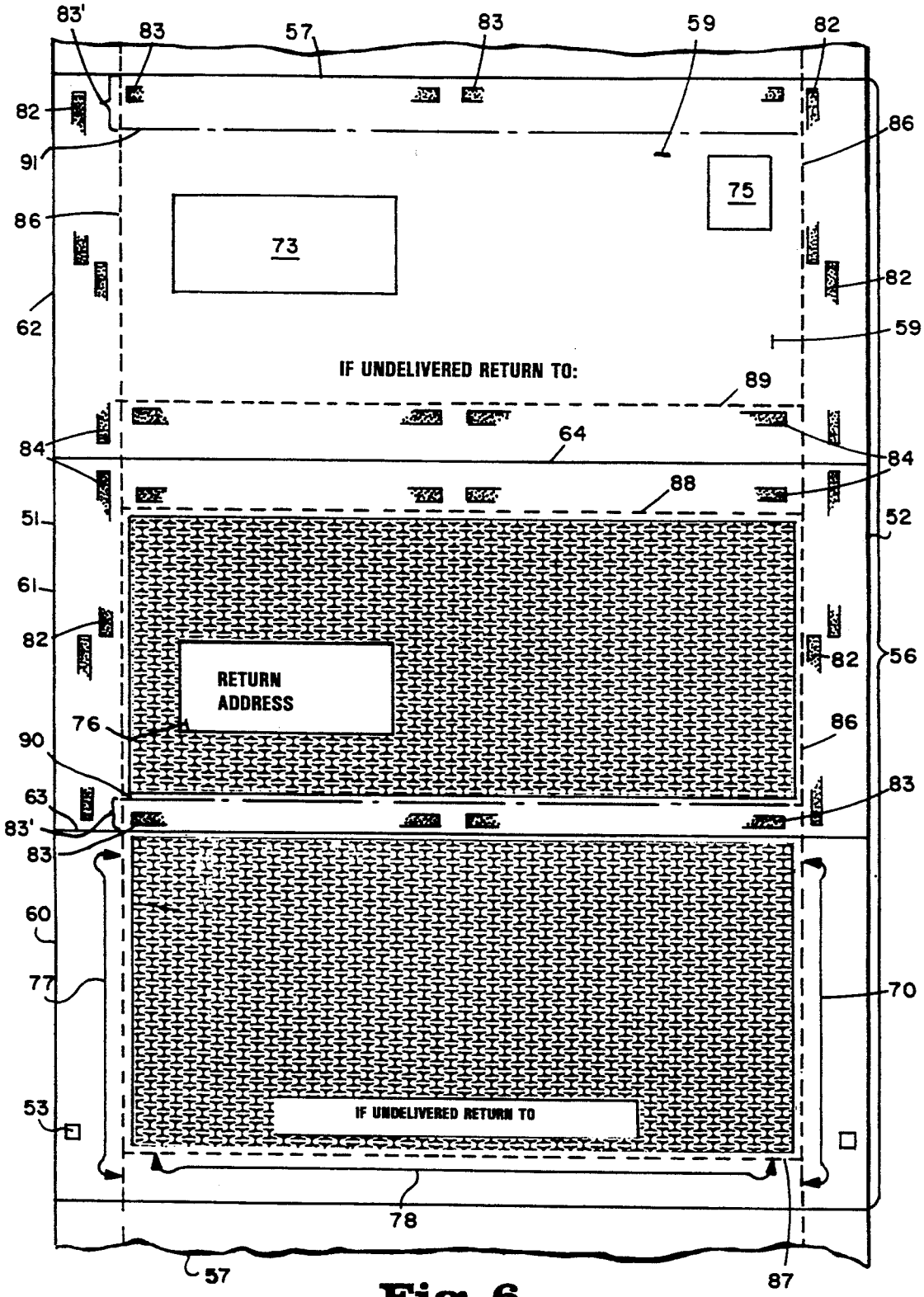
FIG. 6 is a view like that of FIG. 5 of the opposite, second, face of the intermediate of FIG. 5.

The continuous mailer assembly of FIGS. 5 to 11 comprise a continuous web 50 having longitudinal edges 51, 52 formed as in the embodiment of FIGS. 1 to 4, with a longitudinal line of feed holes indicated at 53 and is divided into a plurality of intermediates (form lengths) 56 by transverse lines of perforation 57, each intermediate 56 to form one outgoing mailer. The web has a front face 58 as shown in FIG. 5 and a rear face 59 as shown in FIG. 6 and is printed on both faces with all the information common to all form lengths.

Each form intermediate 56 is intended to be Z-folded to form an outgoing mailer type business form and for this purpose is divided into three substantially equal-size panels 60, 61, 62 by first and second fold lines 63, 64.

The first panel 60 has on its front side 58 an area 65 intended to be covered by a masking O.P.A.S. patch (as seen at 54 in FIG. 7) carrying transfer material as in the FIGS. 1 to 4 embodiment. Adjacent the area 65 is an area 66 intended to be preprinted with instructions to a customer for dealing with the PIN number received.

The second, central, panel 61 has on its face 58 an area 67 for receiving a reply address, such as the branch address of a bank, and an area 68 preprinted with the following or similar instructions (and including a space for receiving a signature):

"Important Return Instructions

1. Sign the line below marked X using your normal signature.
2. Fold and crease form back on itself so that the window matches your branch address.
3. Lick or moisten the three sides of the form marked side 1, side 2 and side 3.
4. Stick the other leaf of this form onto the three moistened edges to provide a securely sealed envelope and post back to your branch of the bank".

Spaced inwardly from the longitudinal edges 51 and 52 and inwardly from fold line 64 this side of panel 61 is formed where marked side 1, side 2 and side 3 with lines of longitudinal and transverse remoistenable, non-active, adhesives respectively indicated at 70, 71 and 72. The side 58 of panel 61 is intended to form the inside surface of one panel of a reply envelope/mailer.

The third panel 62 is formed with a window opening 73 covered with a transparent (e.g. glassine) patch and its face 58 is intended to form the outside of the outgoing mailer and the inside of the other panel of the reply mailer. For this purpose face 58 may be preprinted with a prepaid post serial number for example in area 74, and has an area 69 intended to receive an individual customer address, and user's reference number for that customer.

As seen in FIG. 6, the side 59 of panel 62 is intended to form the outside of the reply envelope and for this purpose is printed with an area 75 for receiving a stamp.

Face 59 of the central panel 61 has a masking pattern printed over most of its area but with an area 76 free to provide a blank opposite the window opening in the outgoing mailer, the area 76 for receiving an outgoing mailer return address (which may be the same as reply address 67).

Face 59 of the panel 60 is provided over most of its area with a masking pattern but around the edges is printed with dotted lines and opening instructions at 77 and 78 stating respectively "remove the side edges first, fold crease and tear along dotted lines", and "remove side edges first then fold crease and tear this stub along dotted lines".

To form a sealed outgoing mailer from the intermediate 56 of FIGS. 5 and 6, first the length is folded along fold line 63 to bring face 58 of panel 60 into contact with face 58 of panel 61. The longitudinal edges of these faces of these panels and the transverse edges of the panels remote from the fold line 63 are formed with respective longitudinal and transverse lines of pressure seal adhesive, indicated respectively at 80 and 81 such that when the registering areas of adhesive are activated (by pressure) the panels will be secured to one another completely around their edges. Additionally the intermediate 56 is folded along the line 64 in the other direction to bring face 59 of panel 62 into contact with face 59 of panel 61, with window 73 overlying area 76. Again the panels are formed on these faces with patterns 82 of pressure seal adhesive along their longitudinal edges and with patterns 83 of pressure seal adhesive along their transverse edges remote from the fold line 64 and with patterns 84 of pressure adhesive adjacent the fold line 64 so that when the pressure seal adhesive is activated the panels are secured to one another around all four edges including adjacent the fold line 64, with the tabs 83' held together.

Instead of pressure seal adhesive the adhesive could for example be heat activatable in which case there need not be registerable areas on each panel provided the contacting faces of the panels to be sealed have adhesive on one or other panel to form marginal lines of adhesive when the panels are brought together.

Each of the three panels 60, 61 and 62 is formed with longitudinal perforation lines indicated at 86 inside the longitudinal lines of adhesive 80 and 82 and coinciding with and registering (when folded) with the printed dotted lines on side 59 of panel 60. Each of the three panels is also formed with transverse perforation lines 87, 88, 89 extending between the liens 86 and located inside the transverse glue lines 81 and 84. Transverse fold lines are also formed at 90 in panel 61 and at 91 in panel 62 (which lines may be perforated for easy folding, but are not intended to be severed) inside the adhesive line 83, forming a border of tabs 83' receiving the glue lines 83.

The continuous web of FIGS. 5 and 6, normally fan folded along the lines of separation 57, and carrying all the preprinting, adhesive and perforation lines, is sold to a user such as a bank. This user feeds the web through a computerized impact printer which applies the PIN numbers, customers' addresses and bank branch address (which could be preprinted). The form lengths (intermediates) 56 are then separated, folded, sealed and dispatched to individual customers.

Figure 7:
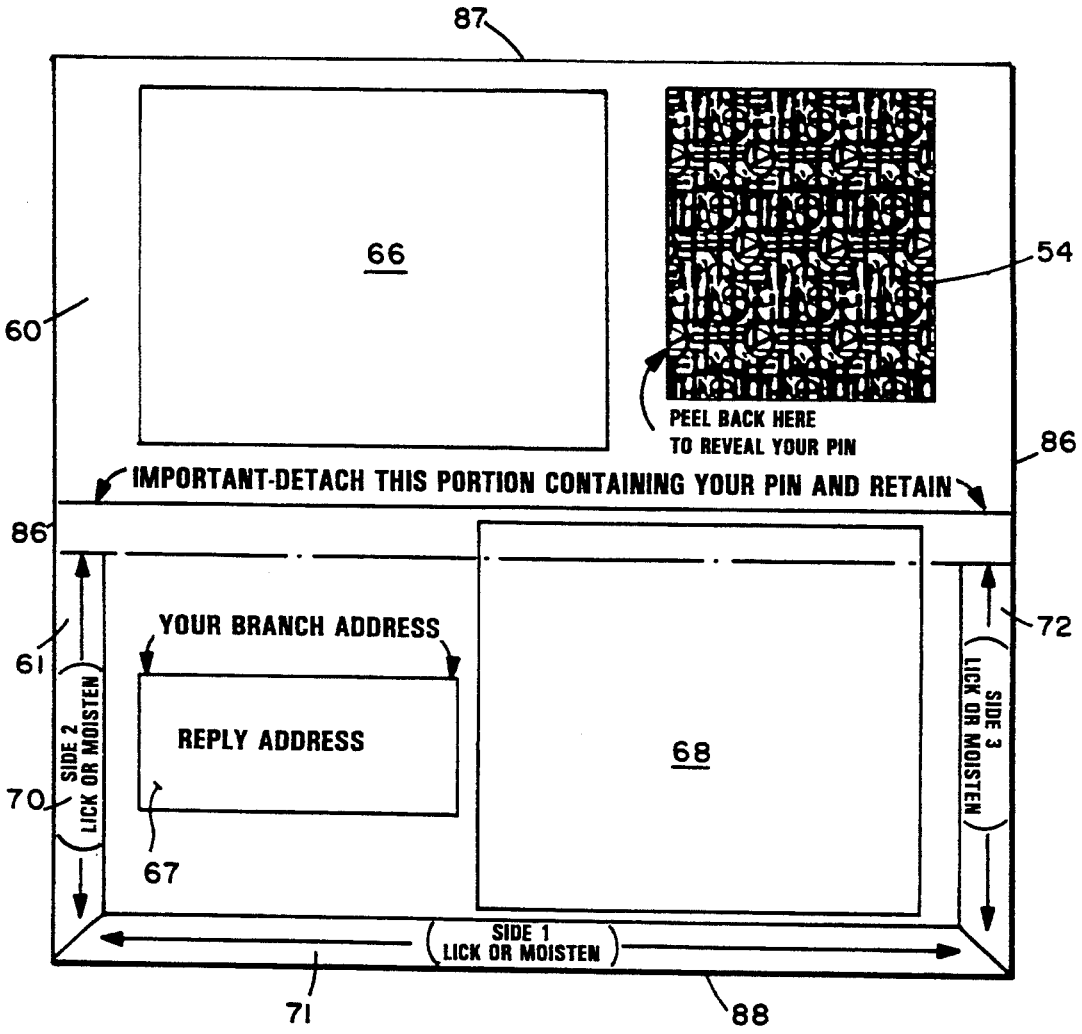
FIG. 7 is a plan view of a mailer constructed from the intermediate of FIGS. 5 and 6 after it has been received and opened by the outgoing addressee.
Figure 8:
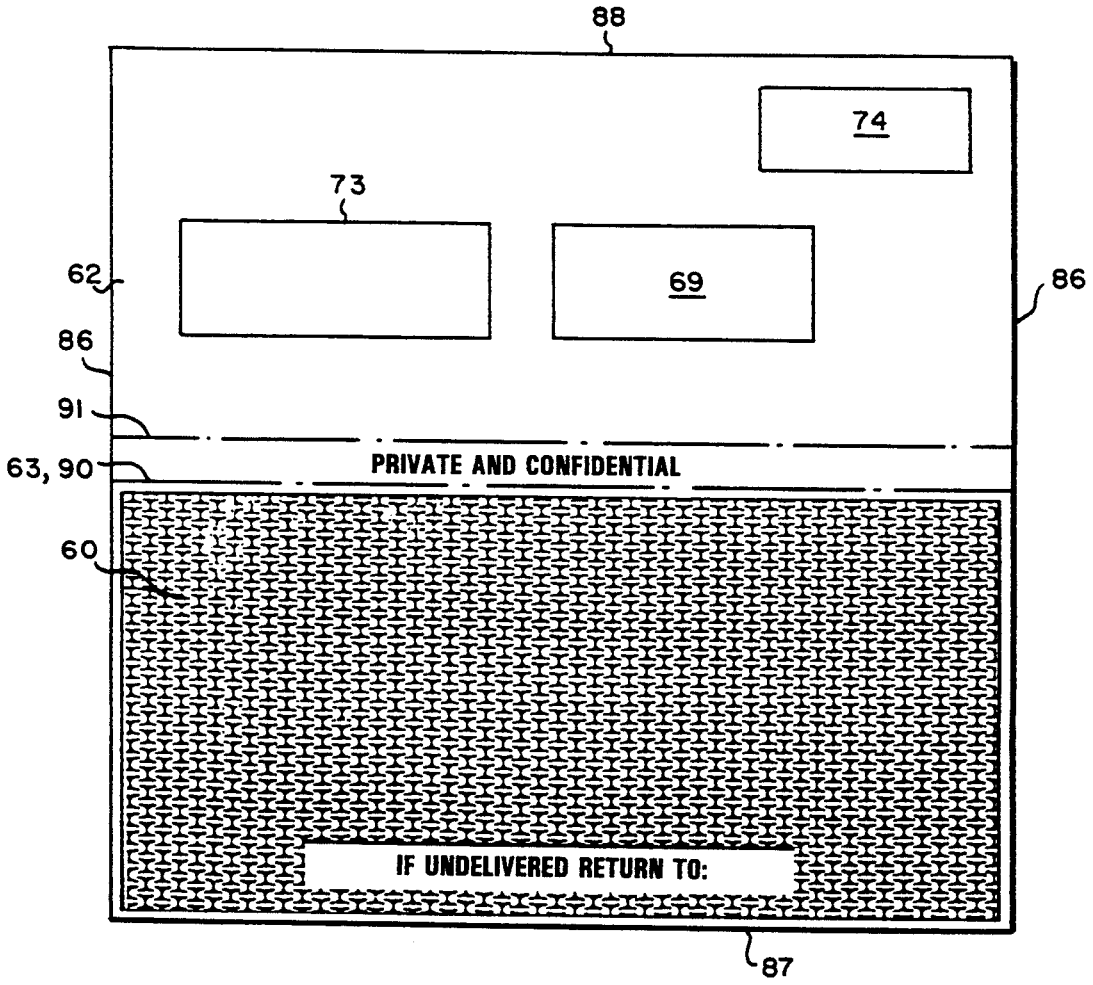
FIG. 8 is a view like that of FIG. 7 only showing the opposite face.

The outgoing addressee receives the sealed outgoing mailer and opens the mailer by detaching the three edge marginal portions by tearing along the perforation lines 86 and 87. The addressee is left with a document in the form of a booklet as seen in FIGS. 7 and 8. FIG. 7 shows the front face of the booklet with panels 60 and 61 still connected as before, along fold line 63, but with panel 62 lying behind panel 61 and adhered thereto by the adhesive lines 84 (see FIG. 6) adjacent the fold line 64. The reverse side of the opened outgoing mailer is shown in FIG. 8.

Figure 9:
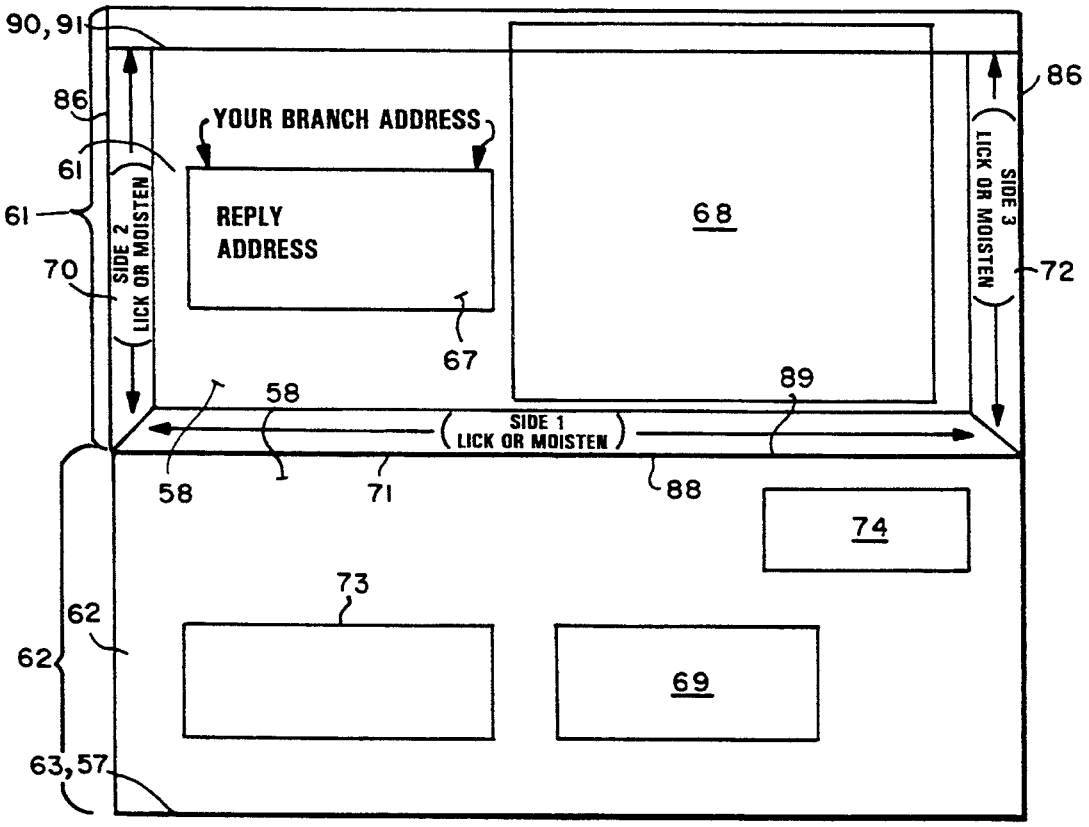

The customer is instructed to detach panel 60 along the perforated fold line 63 and then open out the remaining panels 61 and 62 to form an opened out return envelope as shown in FIGS. 9 and 10. The customer is now instructed to form the remaining panels 61 and 62 into a reply envelope by reverse folding along the lines 90, 91 (inside the glue lines 83, the tabs 83' still held together by glue 83) to bring the face 58 of panel 61 into contact with face 58 of panel 62. In this position the window 73 will register with the area 67 carrying the reply address. The activatable (e.g. rewettable) adhesive at 70, 71 and 72 is then moisturized and the reply envelope/mailer 92 sealed along its three free edges at side 1, side 2 and side 3. This allows each intermediate 56 to be made into both an outgoing mailer and a reply mailer (FIG. 1) which includes an acknowledgement and/or signature. The strip adhered along adhesive line 83 remains inside the return mailer as an integral part thereof.

The Z-fold outgoing/reply mailer assembly could be used for purposes other than conveying PIN numbers, for example without O.P.A.S. patch. While the forms have been described as part of a continuous web, when required all the forms can be in cut sheet form.

Figure 12:
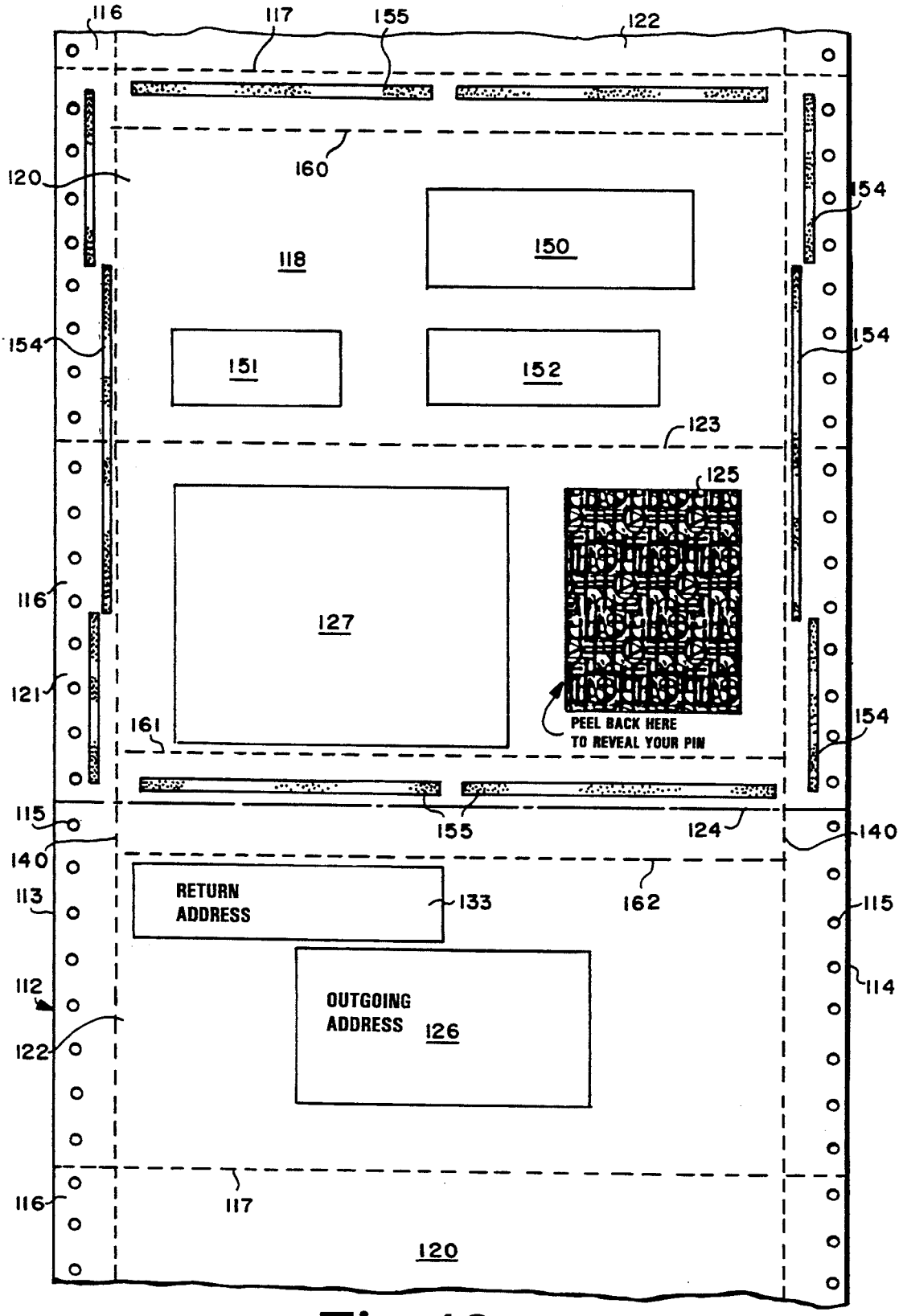
FIGS. 12 and 13 are top plan views of the first and second faces, respectively, of a third embodiment of business form intermediate according to the invention.
Figure 13:
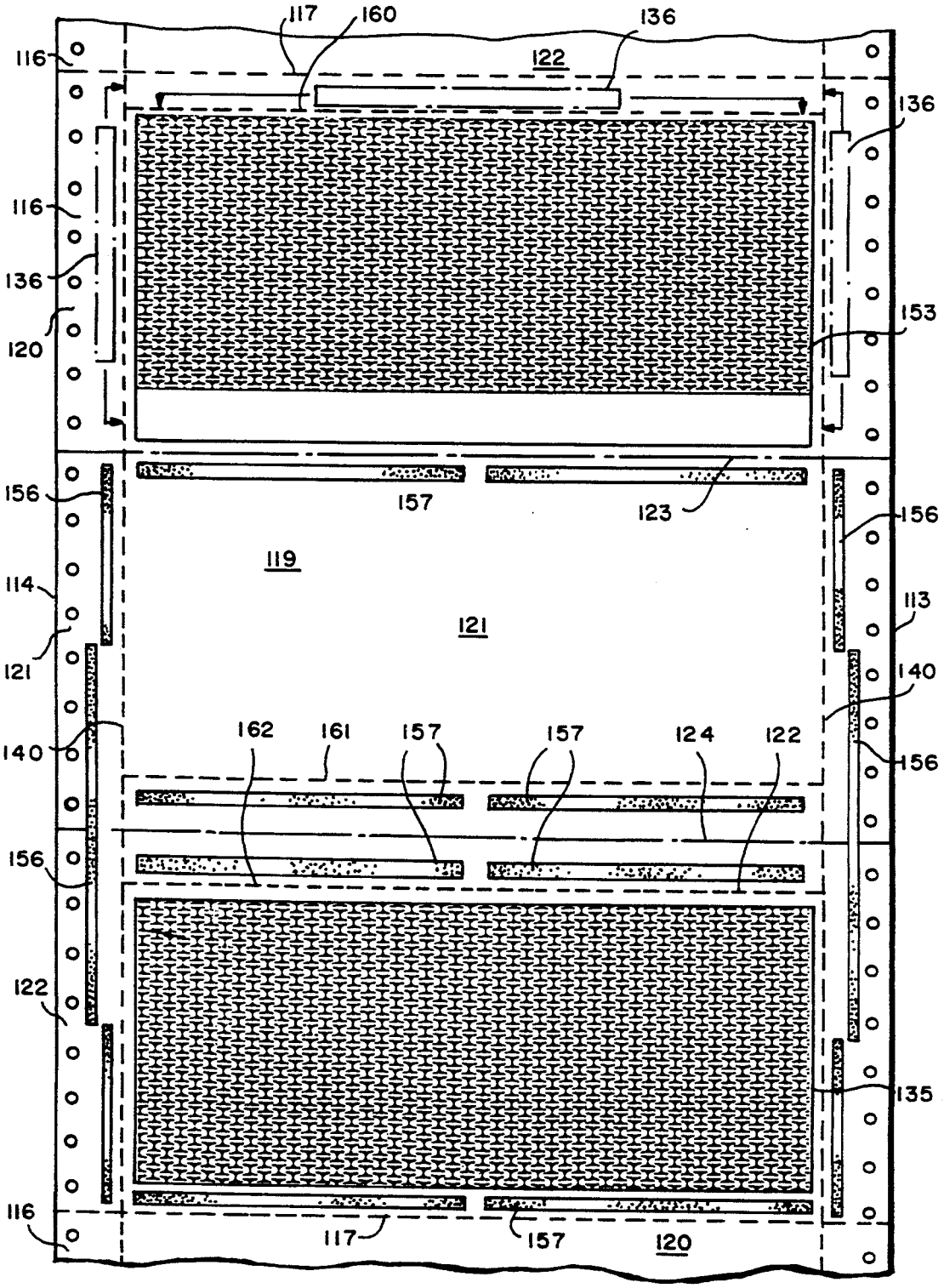

FIGS. 12 and 13 show a further embodiment of web containing business form intermediates designed to be formed into mailers by Z-folding. In this embodiment the mailers are simpler than those described with reference to FIGS. 5 to 11 and closely resemble the mailers of FIGS. 1 to 4 and like parts have been given like reference numerals to those of FIGS. 1 to 4 with the addition of the number "1" in front and will not be re-described.

In FIGS. 12 and 13 each mailer length 116 is divided into three equal panels 120, 121 an 122 by fold lines 123 and 124. Panel 120 is a receipt/acknowledgement panel, which is printed on first face 118 with instructions 150 for completely and returning the panel in a reply envelope which is preferably enclosed as an insert in the mailer. Face 118 of panel 120 is preferably also printed with personalized information at 151 concerning the name and account number of the addressee and requires the user to sign and date the receipt in area 152. The second (reverse) face 119 of panel 120 forms one outside surface of the sealed mailer, and has masking printing 153 and instructions 136 for opening the mailer.

The central panel 121 on its first face 118 carries an O.P.A.S. patch 125 and instructions for dealing with this (and the pin number beneath it) at 127. On the reverse side 119, this panel will carry instructions for keeping the PIN number secure or any other instructions.

Face 118 of panel 122 forms the other outside panel of the eventual mailer and is printed with outgoing personalized addressee information in area 126 and the return address or postage details in panel 133. Its face 119 is provided with masking printing 135.

Face 118 of panels 120 and 121 carry staggered patterns (e.g. continuous strips) of pressure seal (or other) adhesive 154, 155 respectively along their outer longitudinal and transverse edges, and arranged symmetrically about the fold line 123, so that when the panels are folded about the line 123 to bring the faces 118 of these panels into contact with one another, and the adhesive is subjected to pressure, they are sealed together to form a completely sealed unit.

Side 119 of panels 121 and 122 are provided with staggered longitudinally extending strips of adhesive 156 and transversely extending strips of adhesive 157 along both their transverse edges, symmetrical about the fold line 124, so that when the panels are folded together about the fold line 124 so that their faces 119 contact each other and are subjected to pressure, the panels are sealed to one another substantially completely around their edges so as to form a second completely sealed unit.

All the panels have longitudinally extending perforation lines 140 inside the longitudinal lines of adhesive. In additional panel 120 has transverse perforation line 160 inside the glue line 155, panel 121 has transverse perforation line 161 inside its glue line 155 and panel 122 has transverse perforation line 162 inside the transverse line of adhesive 157 nearest the fold line 124. When the intermediate has been Z-folded to form the mailer these lines are all coincident. The mailer is opened by first tearing along the perforation lines 140 at each side and then tearing along the coincident perforation lines 160, 161 and 162.

As described in relation to the embodiment of FIGS. 1 to 4, in the sealed mailer unit the panel carrying the O.P.A.S. patch is sandwiched between the other two panels, while when the unit is opened the panel carrying the O.P.A.S. patch is automatically completely detached from the panel carrying the addressee information.

The fold line 123 is preferably perforated to assist the user in detaching the receipt panel 120 so that it can be returned to the send.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A business form intermediate comprising:

a sheet having first and second opposite faces, parallel first and second edges, and parallel third and fourth edges perpendicular to said first and second edges;

first and second fold lines parallel to said first and second edges, and dividing said sheet, and each face thereof, into first, second, and third panels, said first panel bordered by said first edge and first fold line, and said second panel between said first and third panels;

one of said second and third panels having an outgoing address area formed thereon;

one of said first and second panels having a patch, with inner and outer surfaces, adhesively secured to said first face thereof, said patch having an outer surface with masking means associated therewith, and transfer means provided between said patch inner surface and said first or second panel first face; and adhesive patterns associated with said panels for holding said business form in a Z-fold configuration when folded about said first and second fold lines to provide said first panel first face covered by said second panel first face so that said patch is not visible from the exterior of a formed mailer, but so that said outgoing address area is visible from the exterior of a formed mailer.

2. A business form intermediate as recited in claim 1 wherein said outgoing address area is formed on said first face of said third panel.

3. A business form intermediate as recited in claim 2 wherein said adhesive patterns comprise cooperating adhesive patterns formed on said first panel first face and said second panel first face, and said second and third panels second faces, respectively.

4. A business form intermediate as recited in claim 3 wherein the adhesive of said adhesive patterns comprises pressure seal adhesive.

5. A business form intermediate as recited in claim 2 further comprising a window in said third panel adjacent said outgoing address area.

6. A business form intermediate as recited in claim 5 wherein said patch is provided on said first panel first face; and further comprising means for forming a reply mailer from said second and third panels including a reply address area on said second panel first face in alignment with said window when a reply mailer is formed, and activatable adhesive means provided on said second panel first face for holding said second and third panel first faces together when a reply mailer is formed.

7. A business form intermediate as recited in claim 6 further comprising an outgoing return address area formed on said second panel second face in alignment with said window if said second and third panels are folded about said second fold line to bring the second faces of said second and third mailers into face-to-face contact with each other.

8. A business form intermediate as recited in claim 6 further comprising lines of weakness disposed adjacent and parallel to at least some of said first through fourth edges and first and second fold lines, for allowing ready opening of the mailer formed by Z-folding, with the panels thereof adhesively secured to each other; said activatable adhesive comprising strips of adhesive disposed adjacent, and inside of, said lines of weakness.

9. A business form intermediate as recited in claim 2 further comprising masking indicia provided on said first and second panel second faces for minimizing the transparency and translucency of said first and second panels.

10. A business form intermediate as recited in claim 1 wherein said first panel has said patch, further comprising indicia describing the utilization of a PIN number imaged on said first panel first face adjacent said patch.

11. A business form intermediate as recited in claim 1 in continuous format, with like sheets connected along said first and second edges thereof by lines of weakness.

12. A business form intermediate as recited in claim 1 further comprising lines of weakness disposed adjacent and parallel to at least some of said first through fourth edges and first and second fold lines, for allowing ready opening of a mailer formed by Z-folding of the intermediate with the panels thereof adhesively secured to each other.

13. A business form intermediate as recited in claim 1 wherein said transfer means comprises CB and CF coatings on said patch and a portion of said first panel first face.

14. A mailer type business form comprising:

a quadrate sheet having first, second and third panels, each with a first face and a second face, Z-folded about fold lines so that said third panel second face engages said second panel second face and said first panel first face engages said second panel first face, to define first through fourth edges of each panel;

one of said second and third panels having an outgoing address area formed thereon;

one of said first and second panels having a patch, with inner and outer surfaces, adhesively secured to said first face thereof, said patch having an outer surface with masking means associated therewith, and transfer means provided between said patch inner surface and said first panel first face; and adhesive patterns holding said panels together in said Z-folded configuration, with said first faces of said first and second panels in face-to-face engagement with each other.

15. A business form as recited in claim 14 wherein said third panel has said outgoing address area formed on said first face thereof.

16. A business form as recited in claim 15 further Comprising masking indicia provided on said first and second panel second faces for minimizing the transparency and translucency thereof.

17. A business form as recited in claim 14 wherein said transfer means comprises CB and CF coatings on said patch and a portion of said first panel first face.

18. A business form as recited in claim 14 further comprising outgoing address indicia in said outgoing address area, and a PIN number on said first panel first face covered by said patch.

19. A business form as recited in claim 14 wherein said patch is on said first face of said first panel; and wherein said outgoing address area is formed on said first face of said third panel; and further comprising a window formed in said third panel adjacent said outgoing address area and overlying an outgoing return address provided on said second face of said second panel and visible through said window.

20. A business form as recited in claim 14 wherein said patch is on said first face of said first panel; and wherein said outgoing address area is formed on said first face of said third panel; and further comprising means for forming said business form into a reply mailer, comprising lines of weakness disposed adjacent and parallel to at least some of said first through fourth edges, for allowing ready opening of said mailer type business form, a window formed in said third panel adjacent said outgoing address area, reply address indica formed on said second panel first face in alignment with said window when the reply mailer is constructed, and activatable adhesive provided on said second panel first face for sealing said second and third panels together with the first faces thereof in face-to-face contact when the reply mailer is constructed.

21. A mailer type business form comprising:

a quadrate sheet having first, second and third panels, each with a first face and a second face, Z-folded about fold lines so that said third panel second face engages said second panel second face and said first panel first face engages said second panel first face, to define first through fourth edges of each panel;

said first face of said third panel having an outgoing address area formed thereon with an outgoing address therein;

adhesive patterns holding said panels together in said Z-folded configuration, with said first faces of said first and second panels in face-to-face engagement with each other; and means for forming said business form into a reply mailer, comprising lines of weakness disposed adjacent and parallel to at least some of said first through fourth edges, for allowing ready opening of said mailer type business form, a window formed in said third panel adjacent said outgoing address area, reply address indica formed on said second panel first face in alignment with said window when the reply mailer is constructed, and activatable adhesive provided on said second panel first face for sealing said second and third panels together with the first faces thereof in face-to-face contact when the reply mailer is constructed.

22. A business form intermediate comprising:

a sheet having first and second opposite faces, parallel first and second edges, and parallel third and fourth edges perpendicular to said first and second edges;

first and second fold lines parallel to said first and second edges, and dividing said sheet into first, second, and third panels, said first panel bordered by said first edge and first fold line, and said second panel between said first and third panels;

said first face of said third panel having an outgoing address area formed thereon;

adhesive patterns associated with said panels for holding said business form in a Z-fold configuration when folded about said first and second fold lines to provide said first panel first surface covered by said second panel first face so that said patch is not visible from the exterior of a formed mailer, but so that said outgoing address area is visible from the exterior of a formed mailer a window in said third panel adjacent said outgoing address area;

means for forming a reply mailer from said second and third panels including a reply address area on said second panel first face in alignment with said window when a reply mailer is formed, and activatable adhesive means provided on said second panel first face for holding said second and third panel first faces together when a reply mailer is formed.

23. A business form intermediate as recited in claim 22 further comprising an outgoing return address area formed on said second panel second face in alignment with said window if said second and third panels are folded about said second fold line to bring the second faces of said second and third mailers into face-to-face contact with each other.

24. A business form intermediate as recited in claim 23 further comprising lines of weakness disposed adjacent and parallel to at least some of said first through fourth edges and first and second fold lines, for allowing ready opening of the mailer formed by Z-folding, with the panels thereof adhesively secured to each other; said activatable adhesive comprising strips of adhesive disposed adjacent, and inside of, said lines of weakness.

* * * * *